US012156564B2

(12) United States Patent
Plumb

(10) Patent No.: US 12,156,564 B2
(45) Date of Patent: Dec. 3, 2024

(54) GOGGLE BRACE FOR A HELMET

(71) Applicant: Daniel W Plumb, Seattle, WA (US)

(72) Inventor: Daniel W Plumb, Seattle, WA (US)

( * ) Notice: Subject to any disclaimer, the term of this patent is extended or adjusted under 35 U.S.C. 154(b) by 39 days.

(21) Appl. No.: 18/074,481

(22) Filed: Dec. 4, 2022

(65) Prior Publication Data

US 2023/0200479 A1 Jun. 29, 2023

Related U.S. Application Data

(60) Provisional application No. 63/293,693, filed on Dec. 24, 2021.

(51) Int. Cl.
*A42B 3/18* (2006.01)

(52) U.S. Cl.
CPC ..... *A42B 3/185* (2013.01)

(58) Field of Classification Search
CPC ..... A63B 71/10; A42B 3/185
See application file for complete search history.

(56) References Cited

U.S. PATENT DOCUMENTS 9,504,287 B1 * 11/2016 Guffin, III ..... A61F 9/026
2022/0361619 A1 * 11/2022 Weber ..... A61F 9/029

FOREIGN PATENT DOCUMENTS

CA 2759735 * 11/2011 ..... A63B 71/10

* cited by examiner

*Primary Examiner* — Katherine M Moran
(74) *Attorney, Agent, or Firm* — Alloy Patent Law; Walker Griffin Weitzel

(57) ABSTRACT

The present invention relates to a goggle brace for a helmet. The brace includes a first bracket and an extension member. The first bracket includes a first resting member and a first supporting member. The first supporting member enables integrating the brace within the helmet. The extension member has a hole. The brace is attached on the inner surface of the helmet by a fastening member. The goggles is made to rest over the resting member. The goggles is tightened over the braces through a strap. The ends of the strap are attached to the edges of the goggles and other ends of the strap are attached over the rear surface of the helmet though a single strap or two or more buckles or latches.

15 Claims, 7 Drawing Sheets

GOGGLE BRACE FOR A HELMET

CROSS-REFERENCE TO RELATED PATENT DOCUMENTS

This patent application claims the benefit of priority of U.S. Provisional Application No. 63/293,693, entitled "A goggle brace for a helmet," filed 24 Dec. 2021, which is hereby incorporated herein by reference in its entirety.

TECHNICAL FIELD

The present invention relates to a goggle brace. More particularly, the present invention relates to a pair of braces for goggles that can be engaged with the helmet of a rider for providing a support surface for goggles in order to lessen the contact force on a sinus below eyes caused by the goggle frame.

BACKGROUND

In the sport of off-road motorcycle riding, both a helmet and safety goggles are required for safe riding. Goggles are the preferred type of eye protection in dirty conditions as they seal tightly against the face; however, they are not without drawbacks. The use of goggles with a helmet while riding requires them to be tightly fastened around the helmet, this may create pressure on the sinuses below the eyes and pinch the nose. This reduces an optimal air flow through the nose and can lead to significant discomfort with a decrease in physical performance due to more difficulty in breathing if worn for extended periods or under physical strain.

Following are some of the attempts to solve the issues attributed to the goggles attachment: U.S. Pat. No. 9,504,287B1 relates to head wear/eye protection, namely helmets and goggles. More particularly the frame relates to improved head and eye protection in which novel apparatuses are attached to a new platform "goggle frame" that is used in conjunction with a helmet that envelopes a wearer's head.

US20100154093A1 relates to devices and methods for shielding the eyes, and in particular, the eye shield attachment for use in combination with a safety helmet. The helmet has a front brim continuous with a rim extending along each opposite side of the safety helmet to a pair of rim slots in the rim of the safety helmet. The eye shield attachment includes a pair of frames adapted to removably attach to the pair of rim slots in the helmet.

EP2580975A1 relates to an interior for a helmet, in particular a safety helmet, in such a way that an attachment of a pair of protective goggles to the interior is improved. The essence of the interior is that the interior has a carriage which serves for attachment of goggles in the central region of the nose pad. Due to the central attachment of the carriage, it can be attached in an optically inconspicuous manner to the glasses.

Thus, in the view of above prior art, many devices have been designed that are easy to attach but, most of the devices are not effectively equipped to protect the sinus below the eyes from pressure of the goggle frame. Hence there is need for an invention to solve the above deficiencies in prior art and other problems.

SUMMARY

The present invention relates to a goggle brace for a helmet. The brace can provide a resting surface for goggles within the helmet to lift the goggles away from a rider's face in order to relieve pressure in certain areas such as nose bridge and sinuses. The brace can be permanently or removably arranged within the helmet. In an embodiment, a pair of braces can be arranged within one helmet. The braces can be arranged within the helmet with one brace at one side and the other brace at the other side of the helmet.

The brace may include a wedge-shaped first bracket and an extension member arranged with the first bracket. In an embodiment, the extension member can be integrally arranged with the first bracket. The brace may include a first resting member and a first supporting member. The first resting member can be a rectangular flat surface with a definite length and width. The length and width of the first resting member is configured to accommodate the brace along a goggle opening cavity for mounting a visor on the helmet. The first resting member can provide an area for mounting the goggle frame.

The first supporting member can be an arc shaped member integral with the first resting member. The first supporting member may enable integration of the brace within the helmet and provides strength to the resting member against weight of the goggles or any impact load from front or from sides. The first supporting member and the first resting member may be configured in a wedge shape with a cavity therebetween.

Further, the extension member may extend linearly from the first supporting member on the posterior side of the first supporting member. In an embodiment, the angle between the first resting member and the extension member can be approximately 90 degrees. In an embodiment, the angle between the first resting member and the extension member may be adjustable. The extension member can be a flat beam extending away from the supporting member to attach the brace within the helmet. The brace can be arranged within the helmet in such a way that the extension member is attached on an inner surface of the helmet.

Further, the extension member may have a hole configured at an end of the extension member. The brace can be attached within the helmet by a fastening member fitted within the hole. In an embodiment, the distance between the center of the hole and the surface of the first resting member can be constant.

The goggles are mounted over the goggle brace and the goggle brace is mounted within the helmet. In an embodiment, an external hole or cavity can be made over the helmet by an external hole making operation such as drilling or boring etc. The brace can be attached to the helmet by arranging the hole of the brace over the hole or the cavity made within the helmet and inserting the fastening member though the aligned holes. The fastening member can be a threaded member such as screw or bolt.

Further, the goggles can be made to rest over the first resting member in such a way that both edges of the goggles are positioned over each resting member. The goggles can be tightened over the braces through a strap. In an embodiment, the strap can be a Velcro strap. The strap can be tightened in such a way that the strap encircles the frontal and rear surface of the helmet. In an embodiment, ends of the strap are attached to both the edges of the goggles and the rider can wear the goggles by attaching the other ends of the strap over the rear surface of the helmet though two or more buckles or latches.

Various advantages, parts, and features of the braces for goggles of the present invention will be described herein with specificity to make the present invention understandable to one of ordinary skill in the art, both with respect to how to practice the present invention and how to make the present invention.

BRIEF DESCRIPTION OF DRAWINGS

So that the manner in which the above-recited features of the present invention can be understood in detail, a more particular description of the invention, briefly summarized above, may have been referred by embodiments, some of which are illustrated in the appended drawings. It is to be noted, however, that the appended drawings illustrate only typical embodiments of this invention and are therefore not to be considered limiting of its scope, for the invention may admit to other equally effective embodiments.

These and other features, benefits, and advantages of the present invention will become apparent by reference to the following text figure, with like reference numbers referring to like structures across the views, wherein.

DETAILED DESCRIPTION

The present invention relates to a goggle brace for a helmet. The brace provides a fixing arrangement for goggles within the helmet which protects the sinus of the rider from the pressure of the goggles by lessening the contact force. Also, the brace can be attached within any full face helmets having variety of size and shapes.

Figure 1:
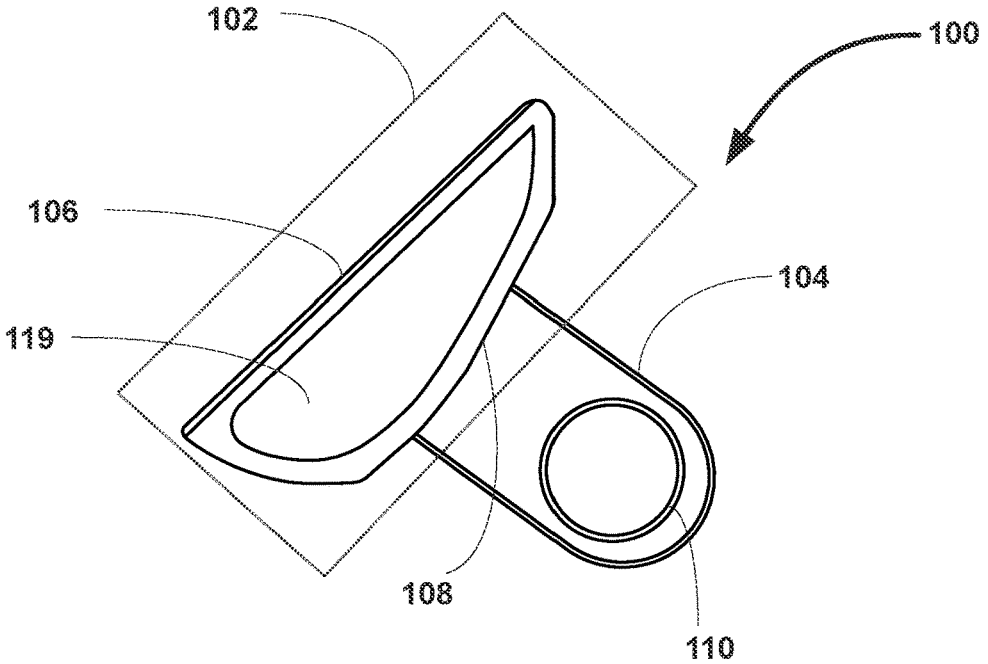
FIG. 1 shows a schematic side view of a goggle brace for a helmet in accordance with the present invention.
Figure 2:
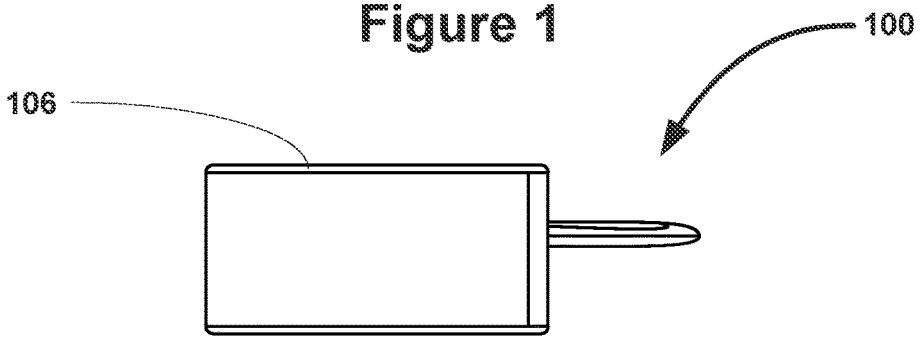
FIG. 2 shows a schematic top view of a goggle brace for a helmet in accordance with the present invention.
Figure 3:
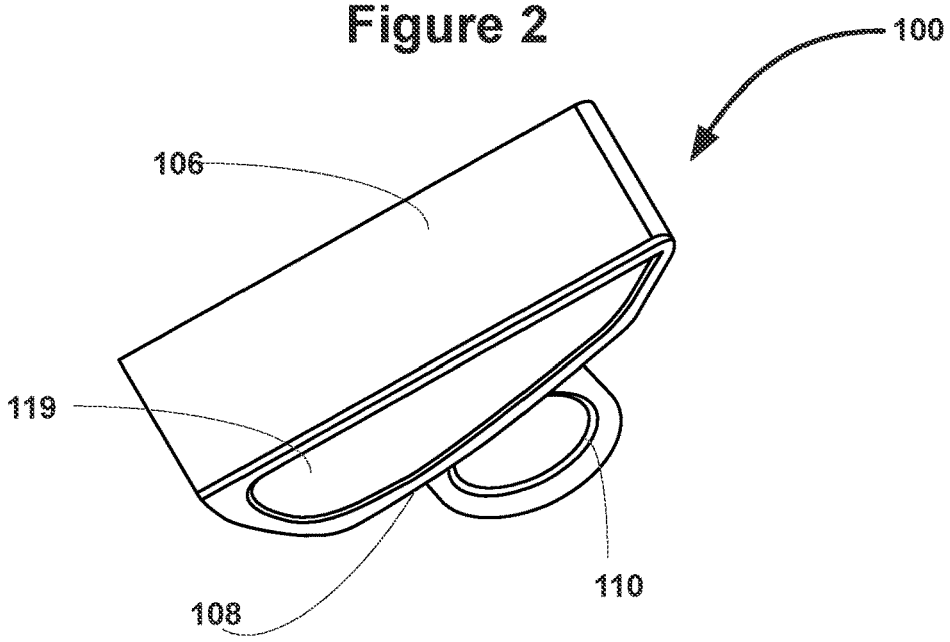
FIG. 3 shows a schematic isometric view of a goggle brace for a helmet in accordance with the present invention.
Figure 4:
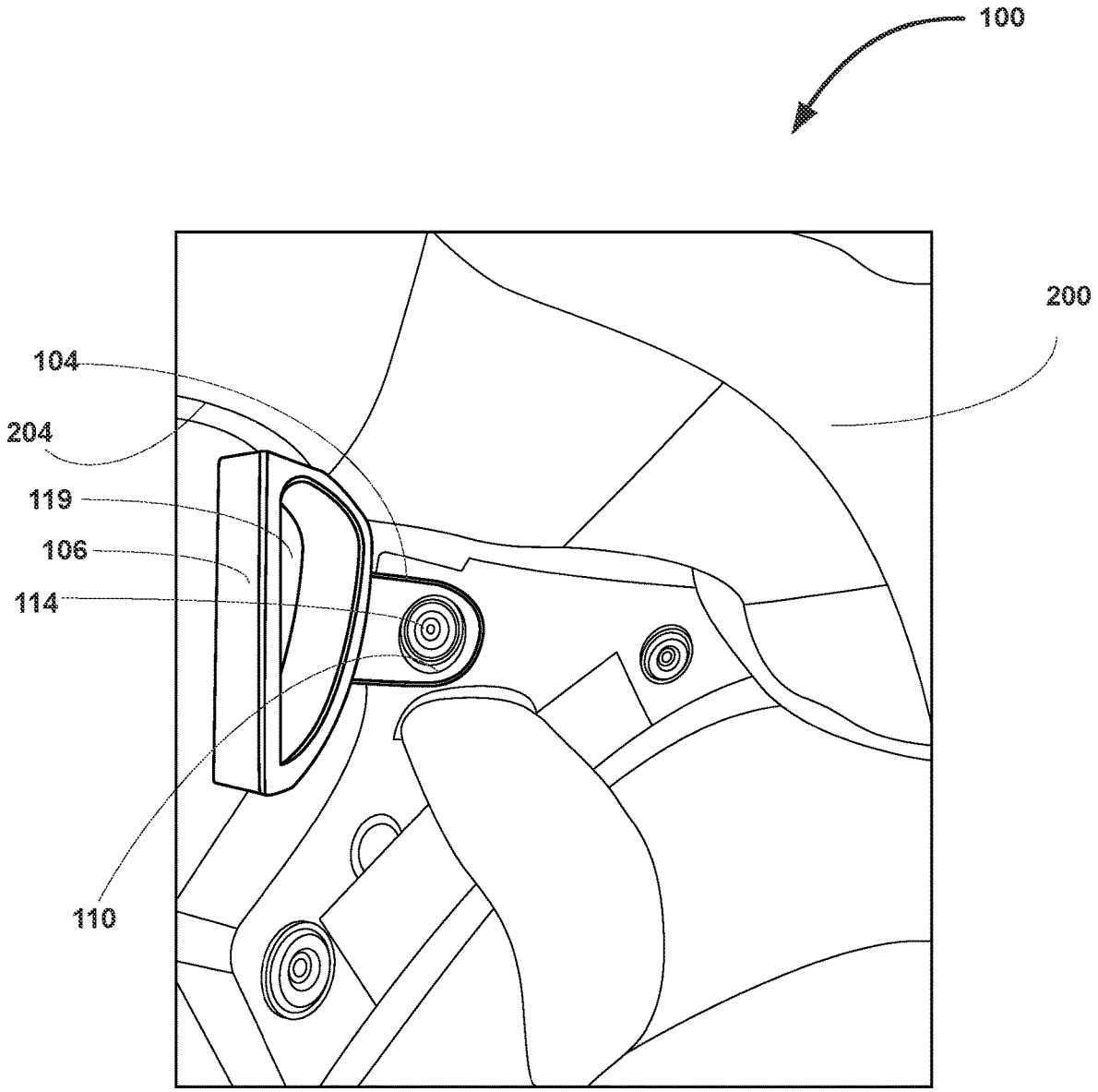
FIG. 4 shows a schematic view of the attachment of the goggle brace within the helmet in accordance with the present invention.

Referring to accompanying figures, particularly FIGS. 1, 2 and 3, a goggle brace 100 for a helmet 200 in accordance with the present invention is illustrated. The brace 100 provides a resting surface for goggles 300 within the helmet 200 to lift the goggles away from a rider's face. The helmet 200 is a full-face or a modular or half or off-road or dual sport or open face or a like. In the preferred embodiment, the brace 100 is permanently arranged within the helmet 200 as shown in FIG. 4.

Figure 5:
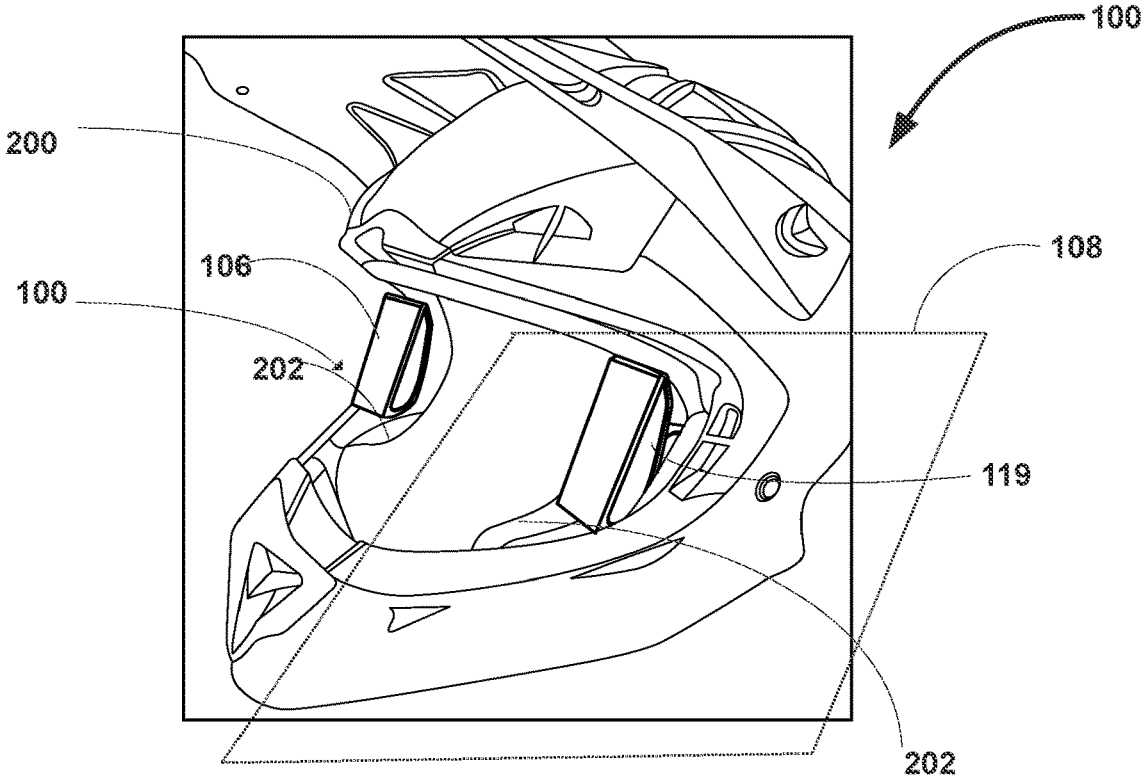
FIG. 5 shows a schematic view of the pair of goggle braces attached within the helmet in accordance with the present invention.

In another embodiment, the brace 100 can be removably attached within the helmet 200. In the preferred embodiment, a pair of braces 100 is arranged within one helmet 200 as shown in FIG. 5. The braces 100 are arranged within the helmet 200 with one brace 100 on inner surface of one of the side plates of the helmet 200 and the other brace 100 on inner surface of the other side plate of the helmet 200. The braces 100 are arranged in such a way that both the braces 100 are symmetrical along a vertical plane and at the both sides of the head of the rider wearing the helmet 200 as shown in FIG. 5.

Figure 6:
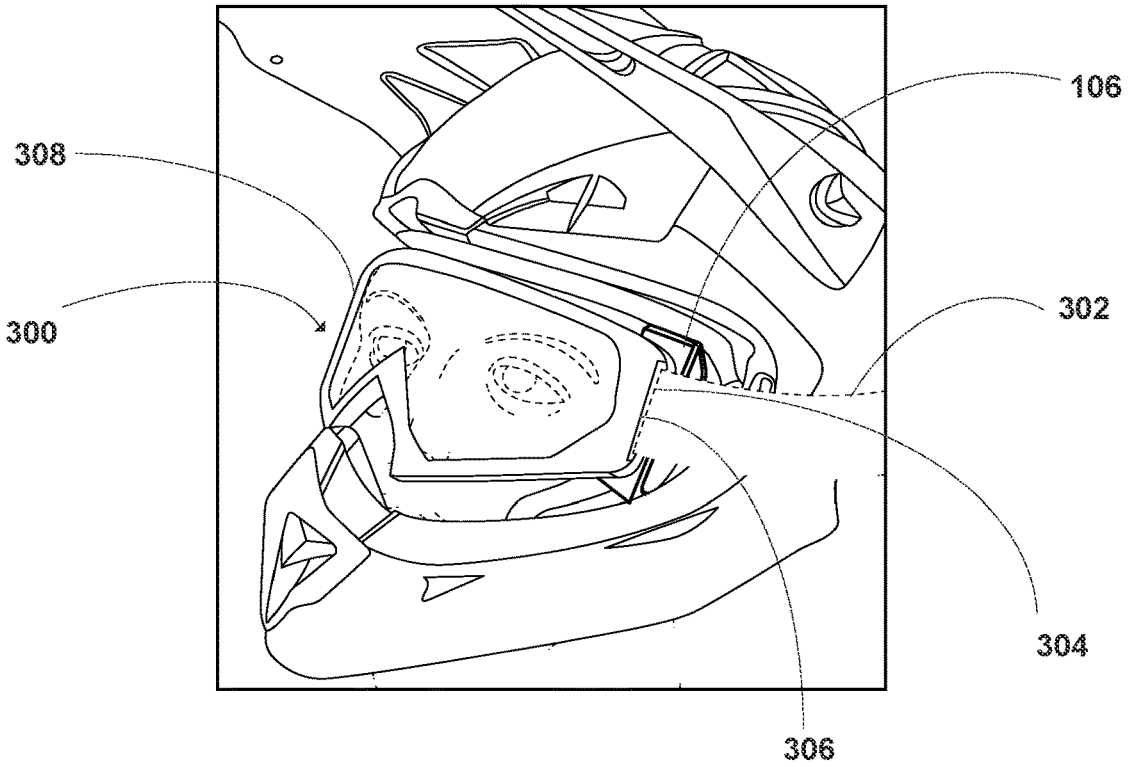
FIG. 6 shows a schematic view of the use of the goggle braces with a goggle configured over the pair of the goggle braces in accordance with the present invention.

The brace 100 includes a wedge-shaped first bracket 102 and an extension member 104 arranged with the first bracket 102 as shown in FIG. 1. In the preferred embodiment, the extension member 104 is integrally arranged with the first bracket 102 as shown in FIG. 1. The first bracket 102 includes a first resting member 106 and a first supporting member 108. The first resting member 106 is a rectangular flat surface with a definite length and width. The length and width of the first resting member 106 is configured to accommodate the brace 100 along a goggle opening cavity 204 for mounting a visor on the helmet 200 as shown in FIG. 4. The first resting member 106 provides an area for mounting the goggles 300 as shown in FIG. 6.

The first supporting member 108 is an arc shaped member integral with the first resting member 106 as shown in FIG. 1. The first supporting member 108 enables integrating the brace 100 within the helmet 200 and provides strength to the first resting member 106 against the weight of the goggles 300 or any impact load from front or from sides. The first supporting member 108 and the first resting member 106 are configured to form a wedge shape with a cavity 119 therebetween as shown in FIG. 1. In another embodiment, the first resting member 106 and the first supporting member 108 are parts of a continuous rigid block without cavity.

Figure 7:
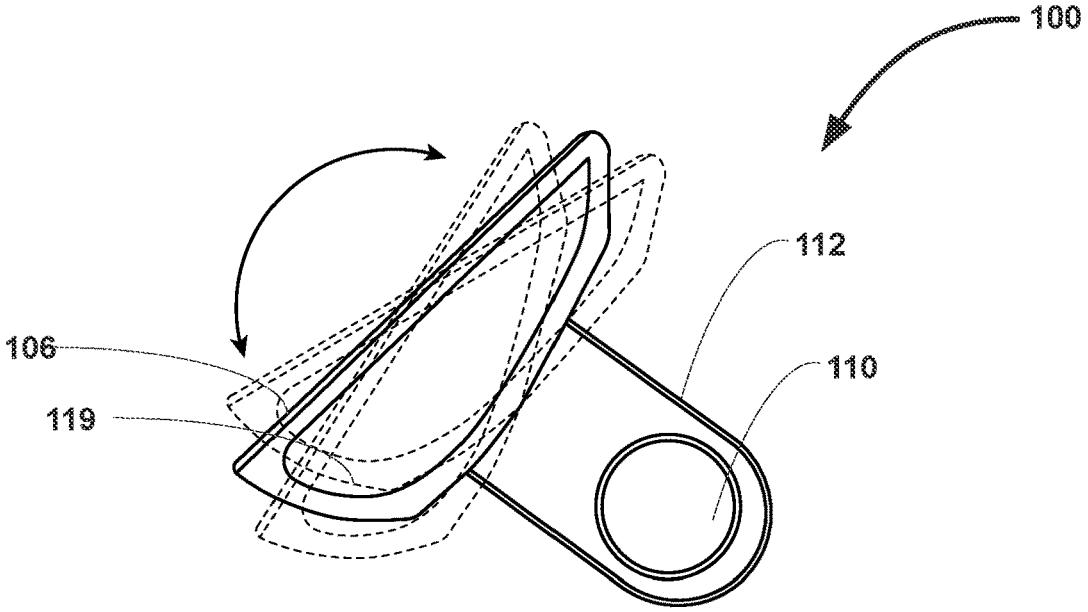
FIG. 7 shows a schematic view of another embodiment of the goggle brace of the present invention with an angular adjustment capability.

Further, the extension member 104 extends linearly from the first supporting member 108 on the posterior side of the first supporting member 108 as shown in FIG. 1. In the preferred embodiment, the angle between the first resting member 106 and the extension member 104 is approximately 90 degrees. In one of the embodiments, the angle between the first resting member 106 and the extension member 104 can be adjusted as shown in FIG. 7. An angular adjustment mechanism such as a pivotal connection between the first bracket 102 and the extension member 104 or any angle adjustment mechanism known to the person skilled in the art can be used to adjust the angle between the first resting member 106 and the extension member 112. The extension member 104 is a flat beam extending away from the first supporting member 108 to attach the brace 100 within the helmet 200 as shown in FIG. 4.

Figure 8:
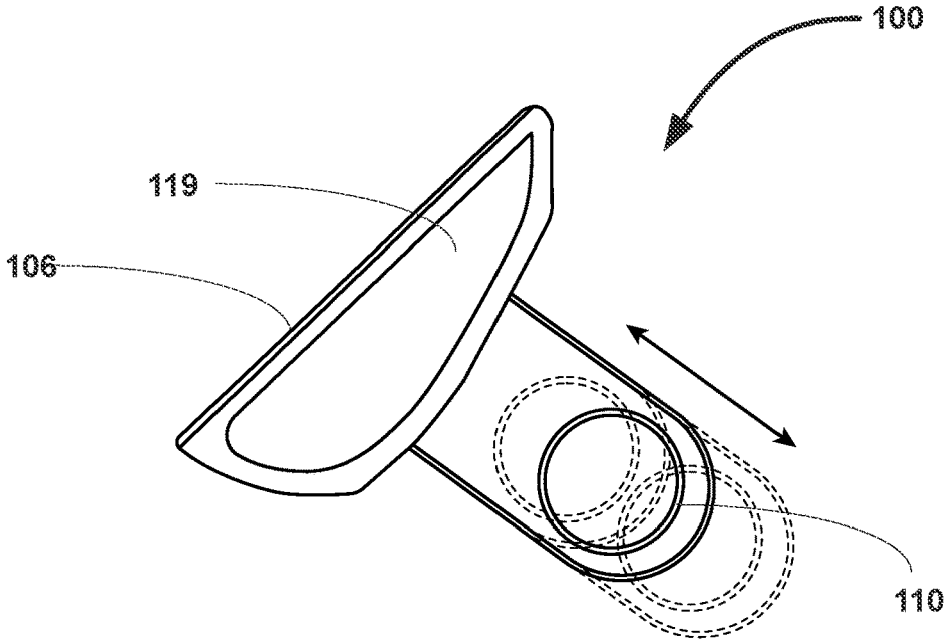
FIG. 8 shows a schematic view of another embodiment of the goggle brace of the present invention with a length adjustment capability.
Figure 9:
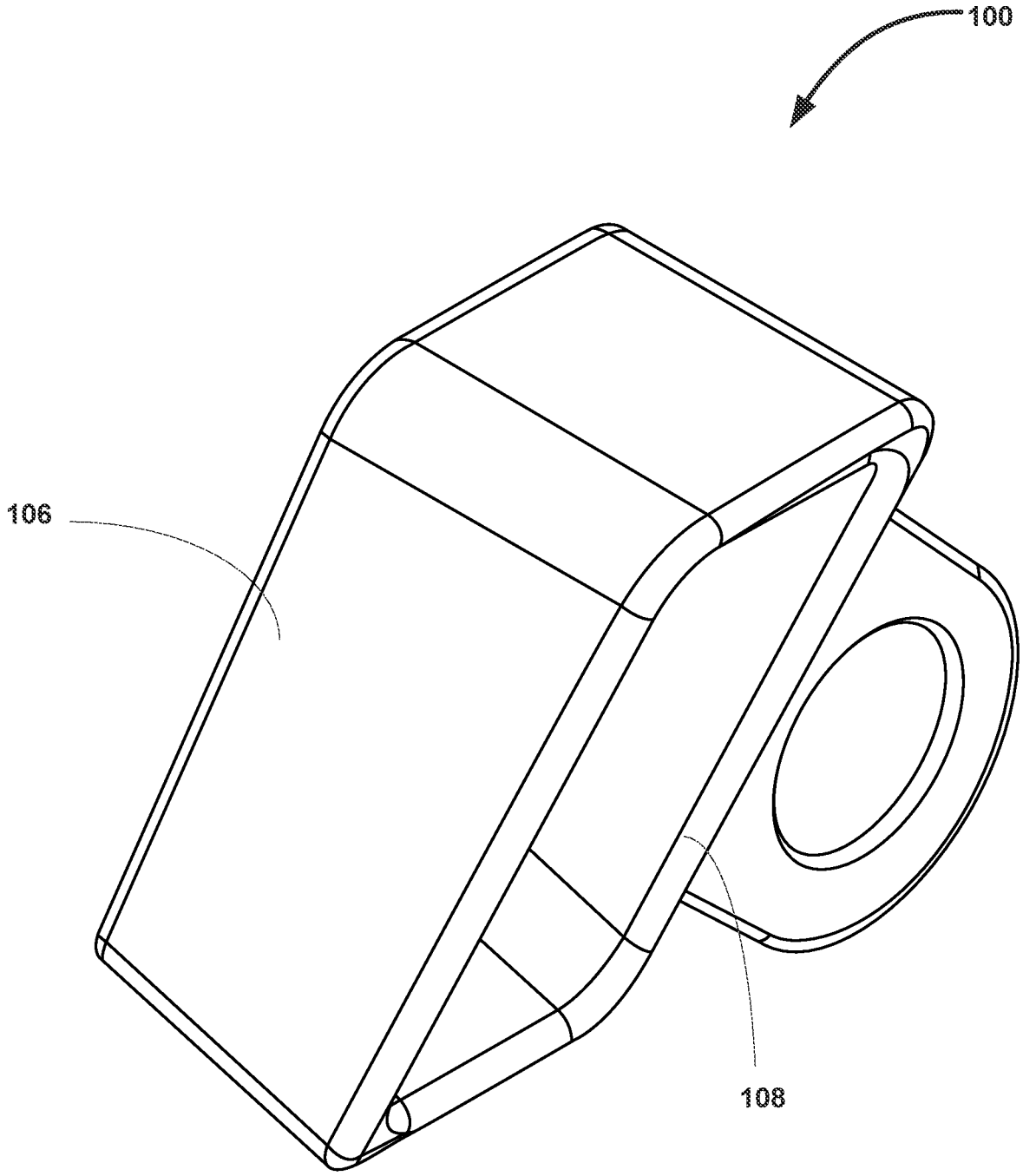
FIG. 9 shows a schematic view of an embodiment of the goggle brace in accordance with yet another embodiment of the present invention.

Further, the extension member 104 has a hole 110 configured at an end of the extension member 104 as shown in FIG. 1. The brace 100 is attached on the inner surface of the helmet 200 by a fastening member 114 fitted within the hole 110 as shown in FIG. 4. The inner surface of the helmet 200 is the surface usually covered by a cheek pad 202 (shown in FIG. 5) of the helmet 200. In the preferred embodiment, the linear distance between the center of the hole 110 and the surface of the first resting member 106 is constant. In another embodiment, the linear distance between the center of the hole 110 and the surface of the first resting member 106 can be adjusted as shown in FIG. 8. A length adjustment mechanism such as multiple linear slots along the extension member 104 and the first bracket 102 be attached with any of the slots with a cylindrical member (not shown) or the extension member 104 configured in two-part form, where one part is slidable with respect to another part or any length adjustment mechanism known to the person skilled in the art can be used to adjust the distance between the center of the hole 110 and the first resting member 106.

The mounting of the goggles 300 over the goggle brace 100 and the mounting of the goggle brace 100 within the helmet 200 is shown in FIG. 6. In an example embodiment, an external hole or cavity (not shown) may be made over the helmet 200 by an external hole making operation such as drilling or boring, etc. The brace 100 is attached to the helmet 200 by arranging the hole 110 over the cavity made within the helmet 200 and inserting the fastening member 114 through the hole 110 as shown in FIG. 4. The fastening member 114 is a threaded member such as screw or bolt or an adhesive or a rivet or a Velcro strap or any permanent or non-permanent fastener known to the person skilled in the art. Both the braces 100 are arranged within the helmet 200 by the process mentioned above.

Further, the goggles 300 are made to rest over the first resting member 106 in such a way both edges 306 and 308 of the goggles 300 are positioned over each first resting member 106 as shown in FIG. 6. The goggles 300 are worn by the rider after wearing the helmet 200. The goggles 300 are tightened over the braces 100 through a strap 302. In the preferred embodiment, the strap 302 is a Velcro strap or an elastic strap or a belt. The strap 302 is tightened in such a way that the strap 302 encircles a rear surface of the helmet 200 as shown in FIG. 6. In the present embodiment, ends 304 of the straps 302 are attached to both the edges 306 and 308 of the goggles 300 and the rider wears the goggles 300 by drawing the elastic strap 302 over the rear surface of the helmet 200 though a single strap or two or more buckles or latches (not shown). Also, the goggles 300 can be fastened to the braces 100 by any permanent joint such as rivet or any non-permanent joint such as a threaded joint known to a person skilled in the art.

In one more alternative embodiment of the goggle brace 100, the extension member 104 is provided without a hole or a cavity (not shown). The extension member 104 is attached directly to the helmet 200 using an adhesive (E.g., glue) or a Velcro.

Figure 10:
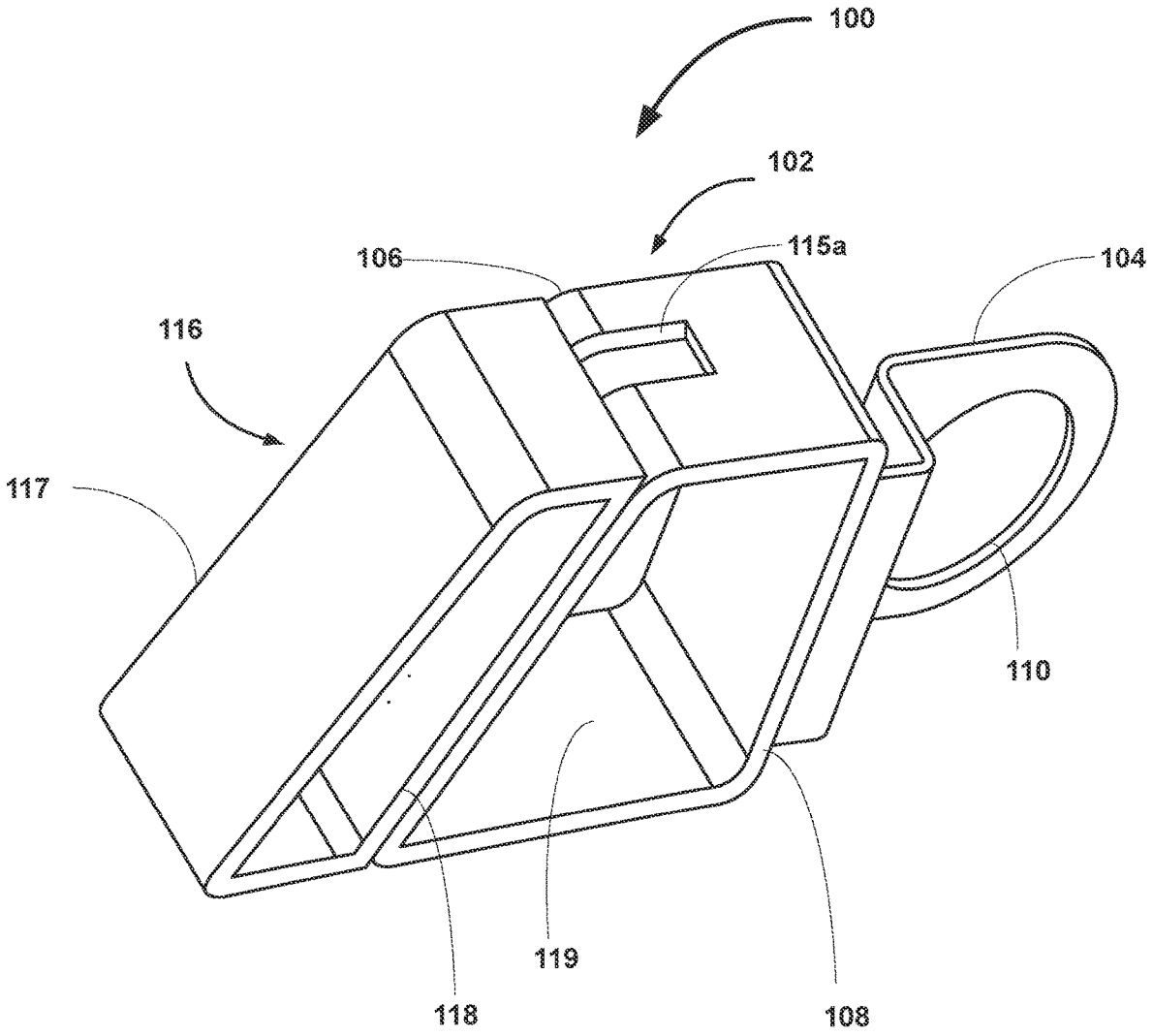
FIG. 10 shows a schematic view of an alternative embodiment of the goggle brace with a second bracket attached to a resting surface of a first bracket.
Figure 11:
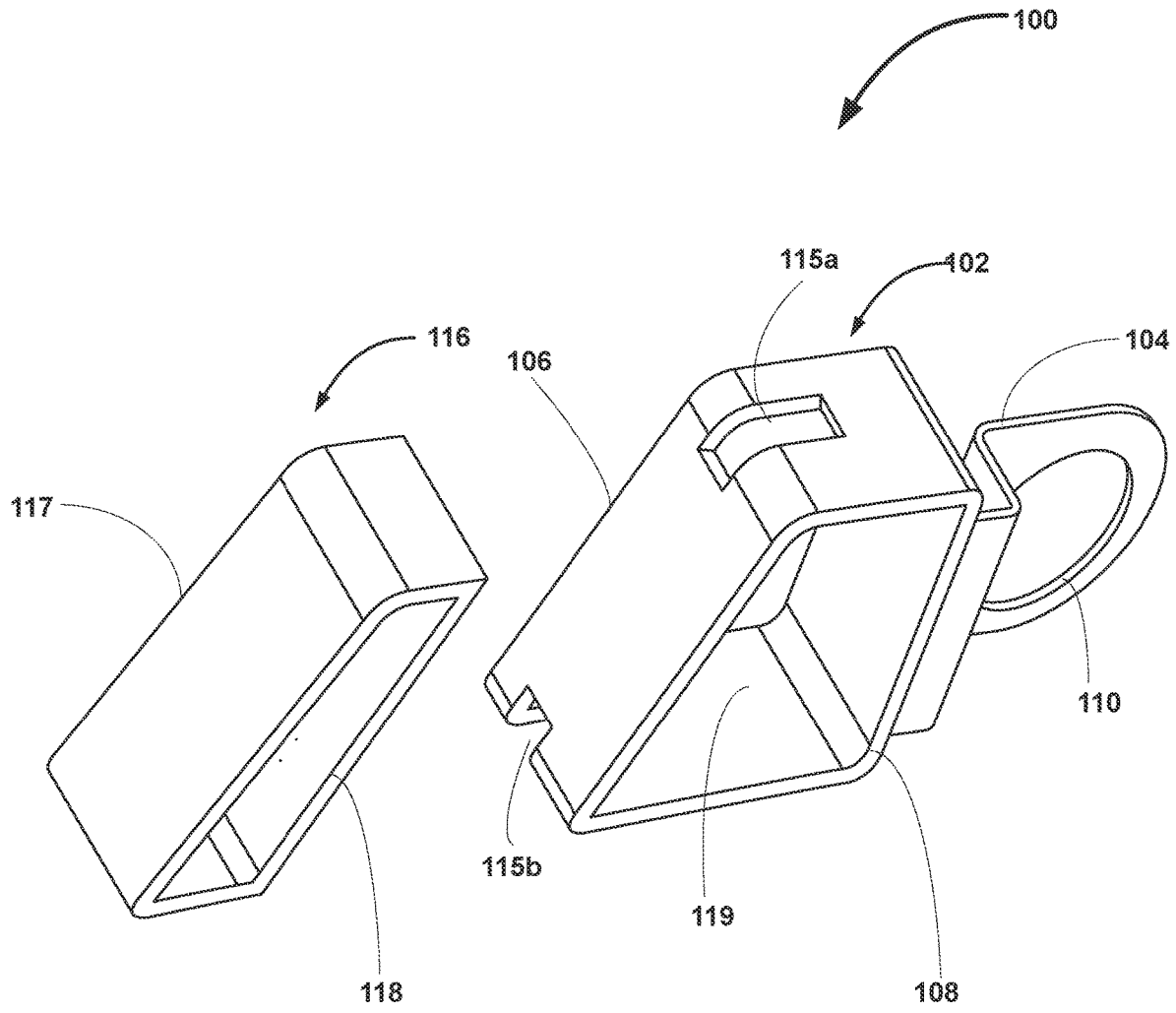
FIG. 11 shows a view of FIG. 10 with the second bracket detached from the resting surface of the bracket.

In one more embodiment of the goggle brace 100, the resting surface 106 of the first bracket 102 is provided with a top notch 115*a* and a bottom notch 115*b* as shown in FIG. 11. Further, the goggle brace 100 includes a second bracket 116. The second bracket 116 that can be detachably attached (clipped) to the first bracket 102 as shown in FIG. 10. More specifically, the second bracket 116 includes a second resting member 117, a second supporting member 118 and a pair of clipping members (not seen). The second resting member 117 provides an area for mounting the goggles 300 when the second bracket 116 is attached to the first bracket 102. The second supporting member 118 is a flat quadrilateral member as shown in FIGS. 10 and 11. The first resting member 106 of the first bracket 102 provides an area for holding the second supporting member 118, when the second bracket 116 is attached to the first bracket 102. The pair of clipping members extends linearly from the second supporting member 118 on the posterior side of the supporting member 118. The pair of clipping members and the second supporting member 118 configures a leaf spring. The top notch 115*a* and the bottom notch 115*b* receives a first clipping member and a second clipping member of the pair of clipping members respectively. The second bracket 116 allows the user to adjust the distance as per his comfort.

Thus, the present invention provides a goggle brace 100 for wearing the goggles with the helmet while riding. The use of braces with the goggles lessens the contact force on the sinus of the user. Further, the brace 100 can be attached to any helmet. Also, the brace 100 is portable, simple in construction and cost-effective.

While the invention has been described in connection with what is presently considered to be the most practical and preferred embodiments, it is to be understood that the invention is not to be limited to the disclosed embodiments, but, on the contrary, is intended to cover various modifications and equivalent arrangements included within the spirit and scope of the appended claims.

What is claimed is:

1. A goggle brace (100) for providing a resting surface for at least one edge (306 or 308) of a goggle (300) within a helmet (200) comprising:

a bracket (102) having a resting member (106) and a supporting member (108) forming a wedge shape thereof;

an extension member (104) that extends linearly from the supporting member (108);

wherein the supporting member (108) enables integration of the goggle brace (100) within the helmet (200) for providing strength to the resting member (106); and wherein the resting member (106) is configured for mounting the goggle (300) and wherein the resting member (106) is a rectangular flat surface with a definite length and width to accommodate the goggle brace (100) along a goggle opening adapted for mounting a visor on the helmet.

2. The goggle brace (100) of claim 1, wherein the supporting member (108) is an arc-shaped member.

3. The goggle brace (100) of claim 1, further comprising a cavity formed between the supporting member (108) and the resting member (106) of the wedge shaped bracket (102).

4. The goggle brace (100) of claim 1, wherein the extension member (104) is provided with a first hole (110) configured at an end thereof at a predefined linear distance from a surface of the resting member (106).

5. The goggle brace (100) of claim 4, wherein the goggle brace (100) is configured to be attached to the helmet (200) by arranging the first hole over a second hole made within the helmet and inserting a fastening member (114) therethrough.

6. The goggle brace (100) of claim 5, wherein the second hole is made over the helmet (200) by an external hole making operation including drilling or boring.

7. The goggle brace (100) of claim 5, wherein the fastening member (114) comprises a threaded member consisting of at least a screw, a bolt, an adhesive, and a rivet.

8. The goggle brace (100) of claim 4, wherein the predefined linear distance between the center of the first hole (110) and the surface of the resting member (106) is constant.

9. The goggle brace (100) of claim 1, wherein an angle between the resting member 106 and the extension member 104 is approximately 90 degrees.

10. A goggle brace (100) comprising:

a bracket (102) having a resting member (106) and a supporting member (108) forming a wedge shape with a cavity (119) therebetween;

an extension member (104) integrally attached to and linearly extending from the supporting member (108);

wherein the goggle brace (100) is configured to provide a resting surface for at least one edge (306 or 308) of a goggle (300) within a helmet (200) to which the goggle brace (100) is attached;

wherein the supporting member (108) is configured to enable integration of the goggle brace (100) within the helmet (200) for providing strength to the resting member (106); and wherein the resting member (106) is configured to act as an area for mounting the goggle (300).

11. The goggle brace (100) of claim 10, wherein the supporting member (108) is an arc-shaped member.

12. The goggle brace (100) of claim 10, wherein the extension member (104) is provided with a first hole (110) configured at an end thereof at a predefined linear distance from a surface of the resting member (106).

13. The goggle brace (100) of claim 12, wherein the goggle brace (100) is configured to be attached to the helmet (200) by arranging the first hole (110) over a second hole made within the helmet (200) and inserting a fastening member (114) therethrough.

14. The goggle brace (100) of claim 13, wherein the fastening member (114) comprises a threaded member consisting of at least a screw, a bolt, an adhesive, and a rivet.

15. A goggle brace (100) for providing a resting surface for at least one edge (306 or 308) of a goggle (300) within a helmet (200) comprising:

a bracket (102) having a resting member (106) and a supporting member (108) forming a wedge shape with a cavity (119) therebetween;

an extension member (104) that extends linearly from the supporting member (108) and is provided with a first hole (110) configured at an end thereof at a predefined linear distance from a surface of the resting member (106);

wherein the goggle brace (100) is configured to be attached to the helmet (200) by arranging the first hole (110) over a second hole made within the helmet (200) and inserting a fastening member (114) therethrough;

wherein the first supporting member (108) is configured for integration of the goggle brace (100) within the helmet (200) for providing strength to the resting member (106); and wherein the resting member (106) is configured for mounting the goggle (300).

* * * * *